US006745408B2

(12) United States Patent
Spells, Sr.

(10) Patent No.: US 6,745,408 B2
(45) Date of Patent: Jun. 8, 2004

(54) NON-LEAKING FLUSH TOILET KIT

(76) Inventor: Michael Spells, Sr., 2416 S. Rotherwood Ave., City of Evansville, Vanderburgh County, IN (US) 47713

( * ) Notice: Subject to any disclaimer, the term of this patent is extended or adjusted under 35 U.S.C. 154(b) by 79 days.

(21) Appl. No.: 09/909,243

(22) Filed: Jul. 19, 2001

(65) Prior Publication Data

US 2002/0023294 A1 Feb. 28, 2002

Related U.S. Application Data

(60) Provisional application No. 60/219,588, filed on Jul. 20, 2000.

(51) Int. Cl.[7] ..... E03D 11/17

(52) U.S. Cl. ..... 4/252.5; 4/252.1; 4/252.6

(58) Field of Search ..... 4/252.1, 252.4, 4/252.5, 252.6

(56) References Cited

U.S. PATENT DOCUMENTS

| | | | | | |
|---|---|---|---|---|---|
| 807,265 | A | * | 12/1905 | Gutelius | 4/252.4 |
| 3,349,412 | A | * | 10/1967 | Schwartz et al. | 4/252.6 |
| 4,090,267 | A | * | 5/1978 | Cuschera | 4/252.5 |
| 4,406,480 | A | * | 9/1983 | Izzi | 4/252.5 |
| 5,185,890 | A | * | 2/1993 | Dismore et al. | 4/252.5 |
| 2002/0166161 | A1 | * | 11/2002 | Carwile | 4/252.6 |

* cited by examiner

*Primary Examiner*—Robert M. Fetsuga
(74) *Attorney, Agent, or Firm*—Gary K. Price, Esq.

(57) ABSTRACT

A non-leaking flush toilet kit that eliminates the need for using wax gaskets or rings on a toilet system. Such kit includes a floor flange, a toilet base extension sleeve that is affixed to the base outlet opening of a flush toilet, and a v-ring seal seated within the floor flange. The floor flange is affixed to a soil pipe at or about floor surface. Said sleeve projects downwardly from the toilet base and is received by the v-ring seal and extends into the soil pipe, and forms a seal between the sleeve and the floor flange, thereby forming a seal between the base of the toilet bowl and the soil pipe.

3 Claims, 7 Drawing Sheets

NON-LEAKING FLUSH TOILET KIT

CROSS REFERENCES TO RELATED APPLICATIONS

U.S. Provisional Application for Patent 60/219,588, filed Jul. 20, 2000, with title, "Non-Leaking Flush Toilet Kit" which is hereby incorporated by reference. Applicant claims priority pursuant to 35 U.S.C. Par. 119(e)(i).

Statement as to rights to inventions made under Federally sponsored research and development: Not Applicable

BACKGROUND OF THE INVENTION

1. Field of the Invention

This invention relates to an apparatus that eliminates the need for using wax gaskets or rings to seal a toilet base to a soil pipe in a toilet system. More specifically, it relates to a kit comprising a toilet base extension sleeve, a floor flange, and a v-ring seal.

2. Brief Description of Prior Art

Prior art methods for preventing the base of the toilet bowl from leaking primarily involve using a wax gasket or ring between the base of the flush toilet and the floor flange to create a seal between the toilet base and the floor flange at or about the floor surface. Such wax gaskets have a relatively short life, and will eventually crack or break, causing leaks, often hidden leaks. Such leaks often go undetected until considerable damage has been caused due to moisture, mold, mildew, and/or rust. The property owner is then required to physically remove the toilet from the floor in order to replace the cracked or broken wax gasket. Such process includes using a putty knife to remove the old wax gasket from the base of the toilet and the floor flange. This process is difficult, inconvenient, and relatively unsanitary.

As will be seen from the subsequent description, the preferred embodiments of the present invention overcome these and other shortcomings of prior art.

SUMMARY OF THE INVENTION

The present invention is designed to eliminate the need for using wax gaskets on toilet systems. The preferred embodiment includes a toilet base extension sleeve that is affixed to the base outlet opening of the flush toilet. It also includes a floor flange and a v-ring seal seated within the floor flange. The floor flange is affixed to a soil pipe at or about floor surface, and the toilet base extension sleeve is received by the v-ring seal within the floor flange, forming a seal between the sleeve and the floor flange, thereby forming a seal between the base of the toilet and the floor flange.

DESCRIPTION OF THE PREFERRED EMBODIMENT

Figure 1:
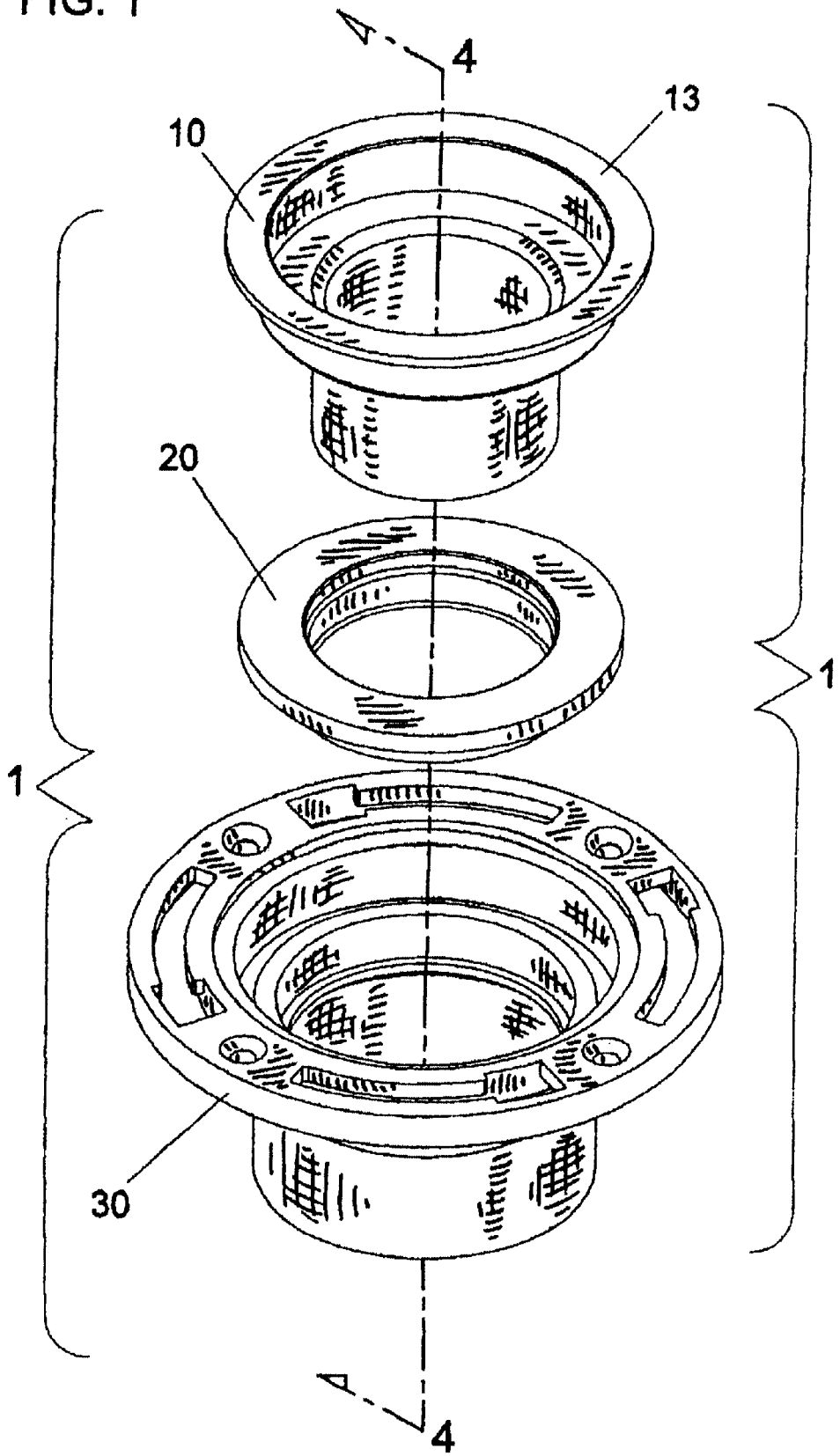
FIG. 1 is an exploded perspective view of the three components of a preferred embodiment of the present invention, namely, a toilet base extension sleeve, a v-ring seal, and a floor flange.

FIGS. 1–5 illustrate a preferred embodiment of a flush toilet kit 1 made in accordance with the present invention. As shown in FIG. 1, the kit 1 includes a toilet base extension sleeve 10, a v-ring seal 20, and a floor flange 30.

Figure 4:
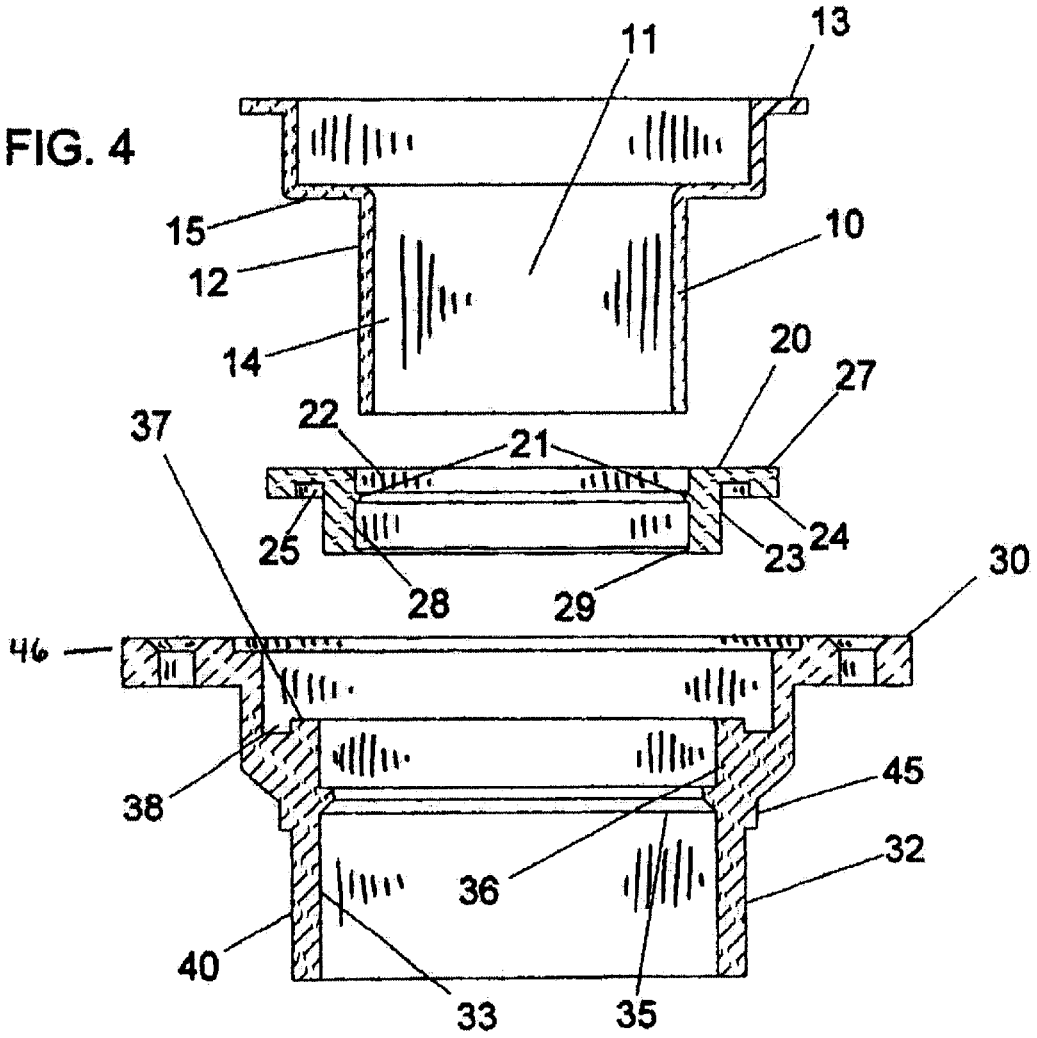
FIG. 4 illustrates an exploded side sectional view, taken along line 4—4 shown in FIG. 1, of the three components of FIG. 1.

As best shown in FIG. 4, the toilet base extension sleeve 10 includes a mounting face 13, an extension member 14, an extension sealing surface 12, and a lower face 15. The extension member 14 has a cylindrical shape and forms a drain clearance 11 therein.

Figure 5:
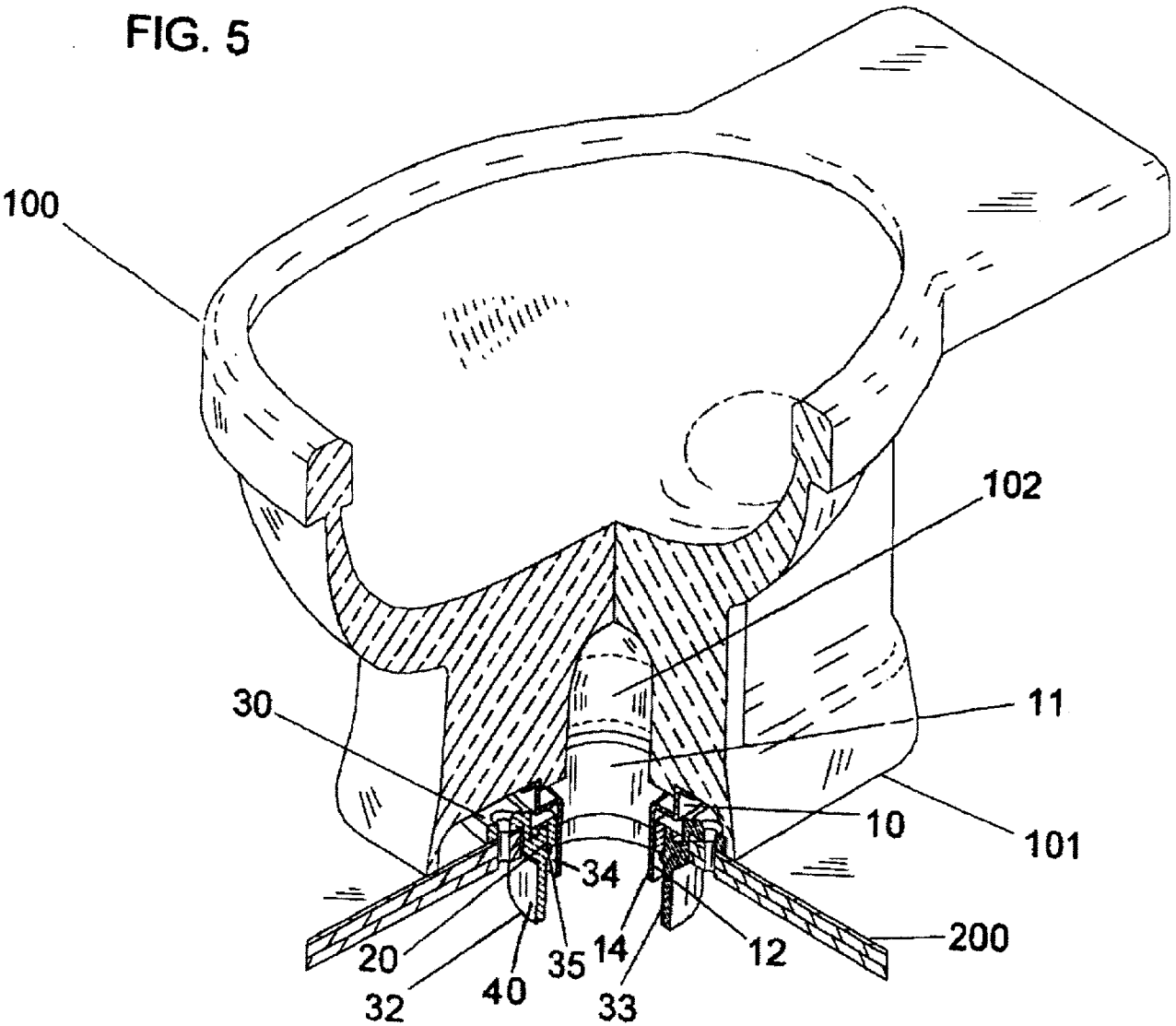
FIG. 5 is a sectional view of the assembly of FIG. 2 mounted on a toilet.

As shown in FIG. 5, a flush toilet 100 includes a toilet base 101, and a base outlet opening 102.

The toilet base extension sleeve 10 is mounted to the toilet base 101 so that the drain clearance 11 is coincident with the base outlet opening 102 of the toilet base 101, by aligning and affixing the mounting face 13 of the toilet base extension sleeve 10 to the toilet base 101. The mounting face 13 of the sleeve 10 is a substantially flat surface and is affixed to the toilet base 101 with any adhesive, preferably any epoxy suitable for bonding plastic to porcelain. Once installed, as shown in FIG. 5, the extension member 14 of the toilet base extension sleeve 10 extends from the toilet base 101 of the flush toilet 100. Once installed, and as will be discussed, water flushing from the toilet 100 will pass through the base outlet opening 102 down through the drain clearance 11 of the sleeve 10.

As shown in FIG. 4, the v-ring seal 20 is a substantially cylindrical body, which includes a sleeve extension clearance 22, an inside sealing surface 28, an outside sealing surface 23, a mounting lip 24, a mounting groove 25, and a top surface 27. The inside seating surface 28 is shaped and sized to receive the extension member 14 with a close fit. The inside sealing surface 28 further including two (2) inwardly-directed seats for sealing with the extension member 14 namely, an upwardly projecting sealing lip 21, and a wiper seal 29 disposed in parallel relationship with said sealing lip 21.

Figure 6:
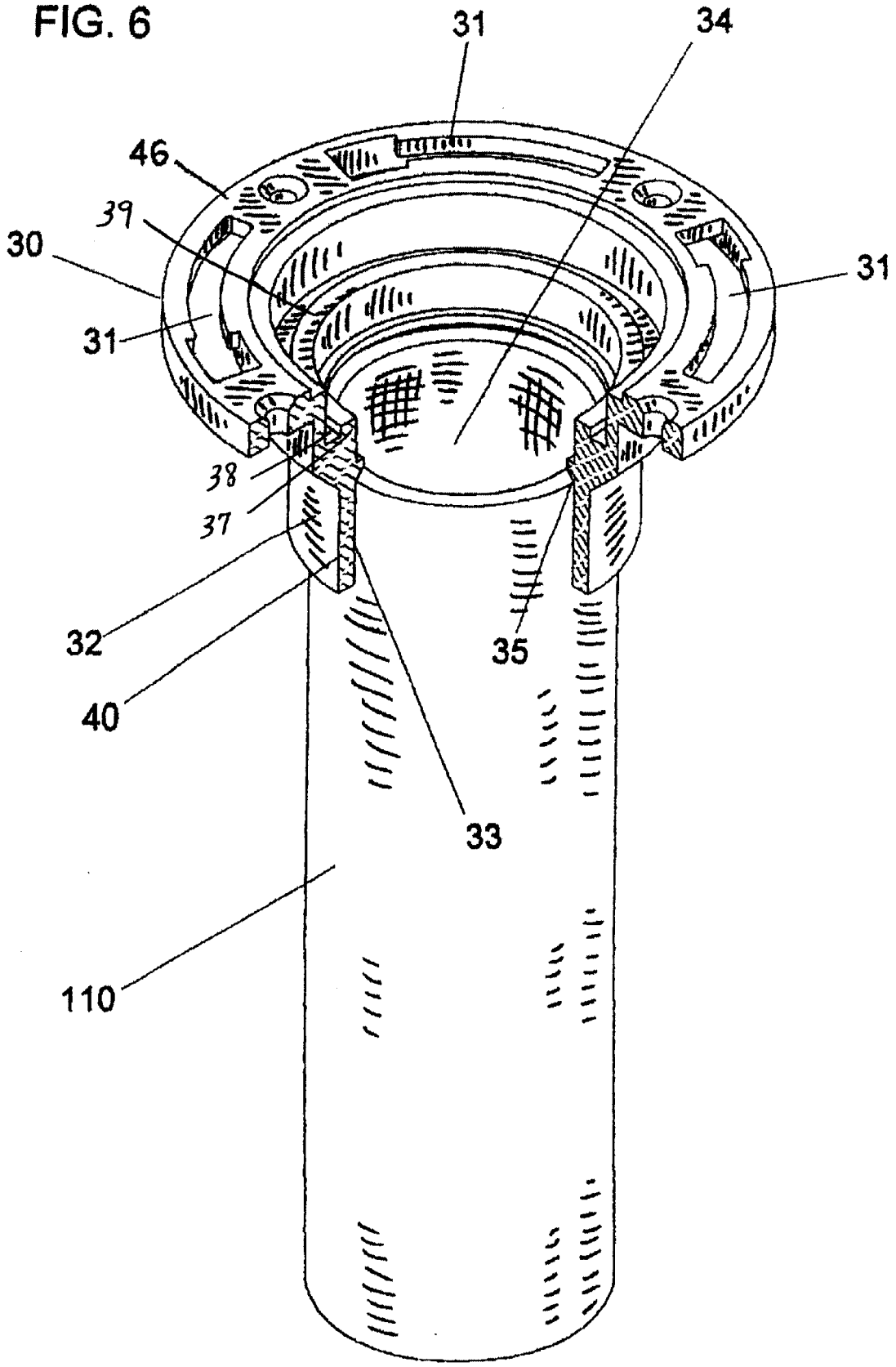
FIG. 6 illustrates a section view of the floor flange of FIG. 1 affixed to a 3" diameter soil pipe.
Figure 7:
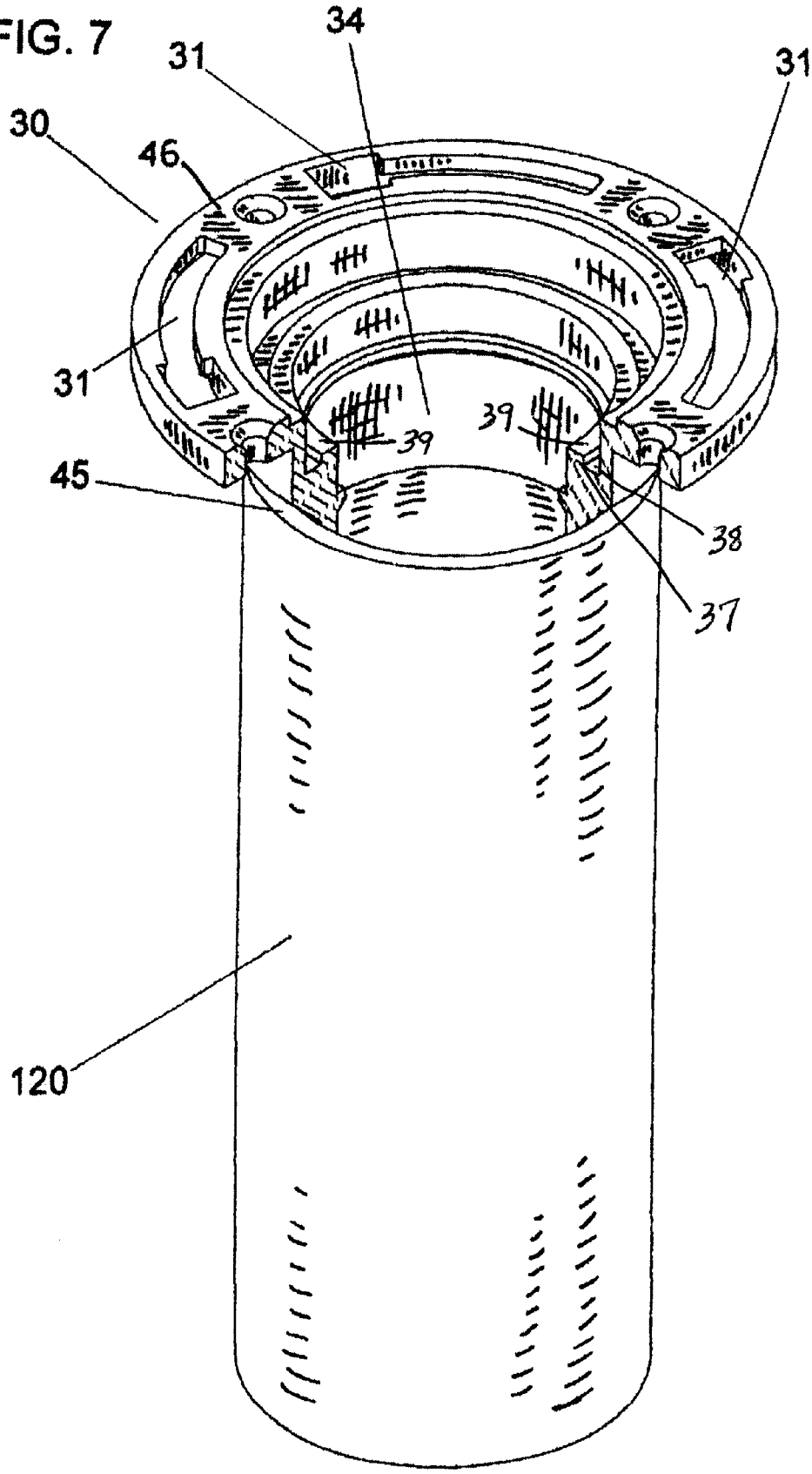
FIG. 7 illustrates a section view of the floor flange of FIG. 1 affixed to a 4" diameter soil pipe.

As shown in FIGS. 4, 6 and 7, the floor flange 30 is a generally cylindrical body with a flange 46 at its top. The flange 46 includes a plurality of mount bolt clearances 31. The cylindrical body includes a first stop ridge 35, a second stop ridge 45, an inner sealing surface 36, an upper surface 39 (shown in FIGS. 6–7) that defines a seal mounting groove 38 and a seal mounting land 37, a flange extension 40, and a soil type clearance 34.

The floor flange 30 is adapted to fit either a standard 3" diameter soil pipe 110 (shown in FIG. 6), or a standard 4" diameter soil pipe 120 (shown in FIG. 7). The downwardly projecting flange extension 40 of the floor flange 30 has an outer surface 32 that bonds to the inside of a large soil pipe (FIG. 7), an inner surface 33 that bonds to the outside of a smaller pipe (FIG. 6). As shown in FIG. 5, the soil pipe clearance 34 is formed between the interior wall of the flange extension 40 and the extension member 14, such clearance 34 is sized to receive a standard 3" diameter soil pipe 110 when the pipe 110 is received inside the extension member 40.

The kit 1 is installed by first mounting the toilet base extension sleeve 10 to the toilet base 101 as previously discussed.

Figure 8:
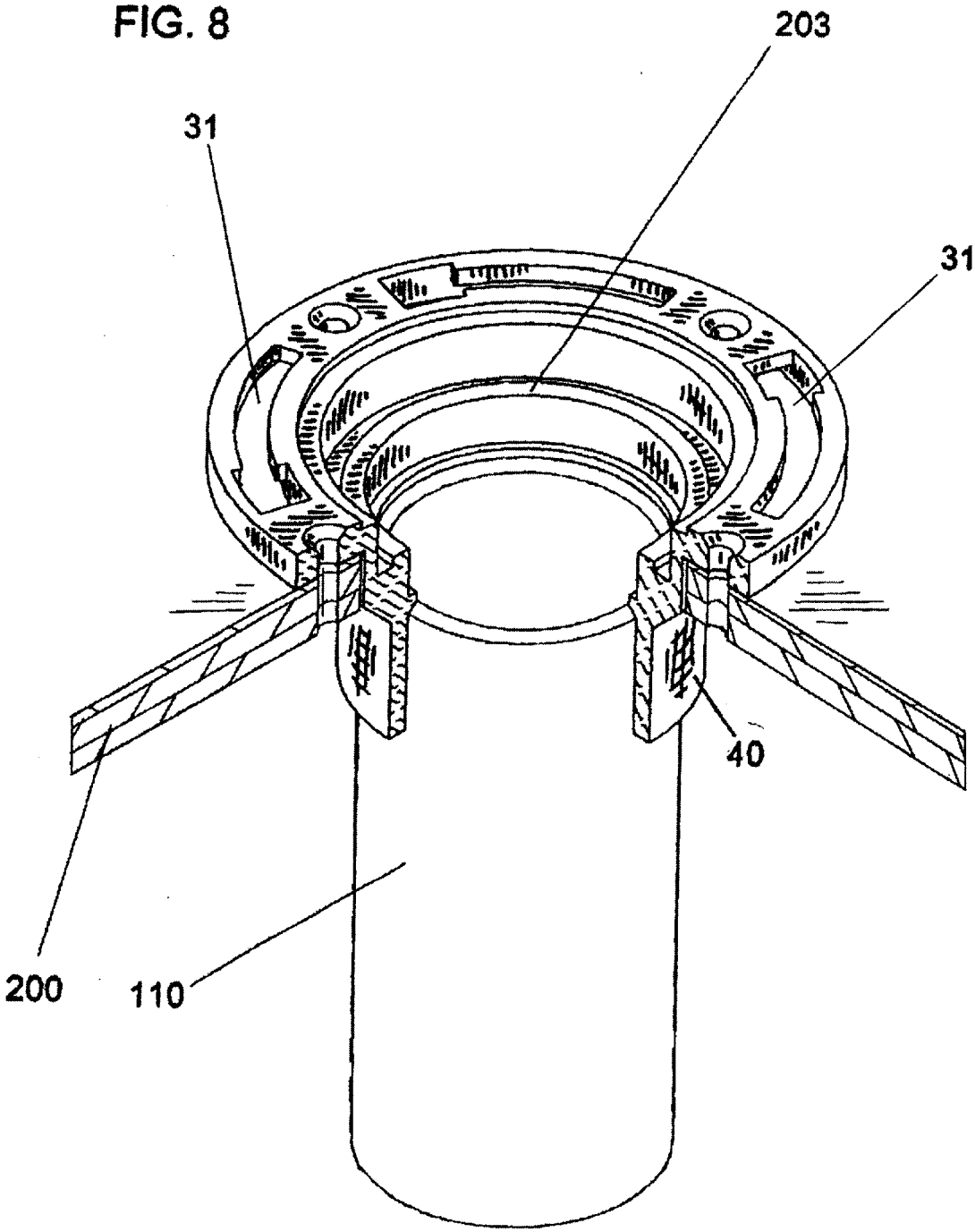
FIG. 8 illustrates a section view of the floor flange of FIG. 1 affixed to the soil pipe at floor surface.

Then, as shown in FIGS. 6 and 7, the floor flange 30 is attached to the plumbing soil pipe at floor surface 200 (shown in FIG. 8). In FIG. 8, the pipe 110 is a 3" pipe, which is received inside the flange extension 40. In the event the floor flange 30 is being attached to a 4" diameter soil pipe 120, the flange extension 40 of the floor flange 30 is slidably positioned inside the soil pipe 120, as shown in FIG. 7, such that the top of the soil pipe 120 abuts the second stop ridge 45 of the floor flange 30. Depending upon which surface of the floor flange extension 40 contacts the soil pipe, that surface will be adhered to the pipe. In FIG. 7, since the extension 40 is inside the soil pipe 120, the outer surface 32 of the extension 40 is affixed to the inner surface of the soil pipe 120 with any suitable adhesive. In the event the floor flange 30 is being attached to the soil pipe having a 3" diameter 110, as shown in FIG. 6, the smaller diameter soil pipe 110 is slidably positioned inside the floor flange 40 such that the top of the soil pipe 110 abuts the first stop ridge 35. The outer surface of the soil pipe 110 is then affixed to the inner surface 33 of the floor flange with any suitable adhesive.

Figure 2:
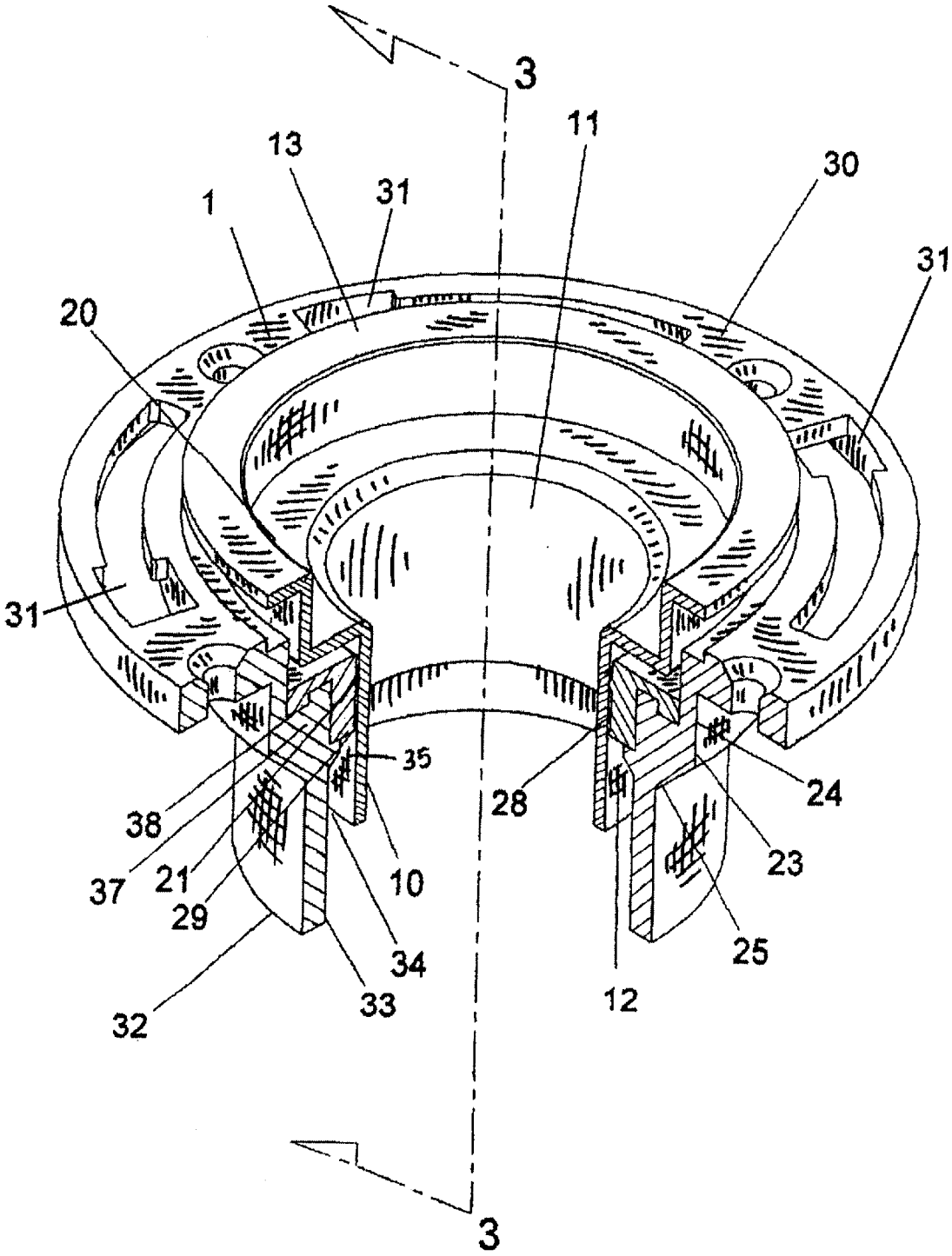
FIG. 2 illustrates a section view of the assembled components of FIG. 1.

Once the floor flange is mounted to the soil pipe, the v-ring seal 20 is seated within the floor flange 30. As best shown in FIG. 2, the outside sealing surface 23 of the v-ring seal 20 is slidably positioned within floor flange 30, forming a seal between the outside sealing surface 23 of the v-ring seal 20 and the sealing surface 36 (shown in FIG. 4) of the floor flange 30. Proper location of v-ring seal 20 within the floor flange 30 is achieved as the mounting lip 24 of the v-ring seal 20 fits within the seal mounting groove 38 of the flange 30, and the seal mounting land 37 of the floor flange 30 is fitted within the mounting groove 25 of the v-ring seal 20. Such land-and-groove fittings assure proper seating of the v-ring seal 20 within the flange 30.

The toilet 100 is attached to the floor flange 30 by conventional closet bolts (not shown) installed upright into the mount bolt clearances 31. The toilet 100 is lowered so the closet bolts installed in the clearances 31 slip through the standard holes (not shown) of the toilet base 101. Washers and nuts are then slipped onto the bolts and tightened.

When the toilet 100 is lowered onto the floor flange 30, the extension member 14 of the sleeve 10 is advanced through the sleeve extension clearance 22 of the v-ring seal 20 and into the floor flange 30. An air tight seal is formed between the inside sealing surface 28 of the v-ring seal 20 and the outer extension sealing surface 12 of the sleeve extension member 14. Such air tight seal is enhanced at locations where the extension sealing surface 12 meets the sealing lip 21 and the wiper seal 29 projections on the interior of the v-ring seal 20. In addition, the advancement of the extension member 14 into the sleeve extension clearance 22 of the v-ring seal 20 further causes pressure on the land-and-groove fittings between the v-ring seal 20 and the flange 30, such that the v-ring seal 20 is securely seated within the floor flange 30.

It should be noted that, once installed, the top surface 27 of the v-ring seal 20 need not be flush with the lower face 15 of the sleeve 10 in order to achieve an air tight seal. Because the seal is between the outer surface 12 of the sleeve 10 and the inside sealing surface 28 of the v-ring seal 20. Further, the seal formed between the outer sealing surface 12 of the sleeve 10 and the inside sealing surface 28 of the v-ring seal 20 is not affected by movement or shifting of the toilet 100. This seal is continuous, regardless of any reasonable movement by the toilet 100.

Figure 3:
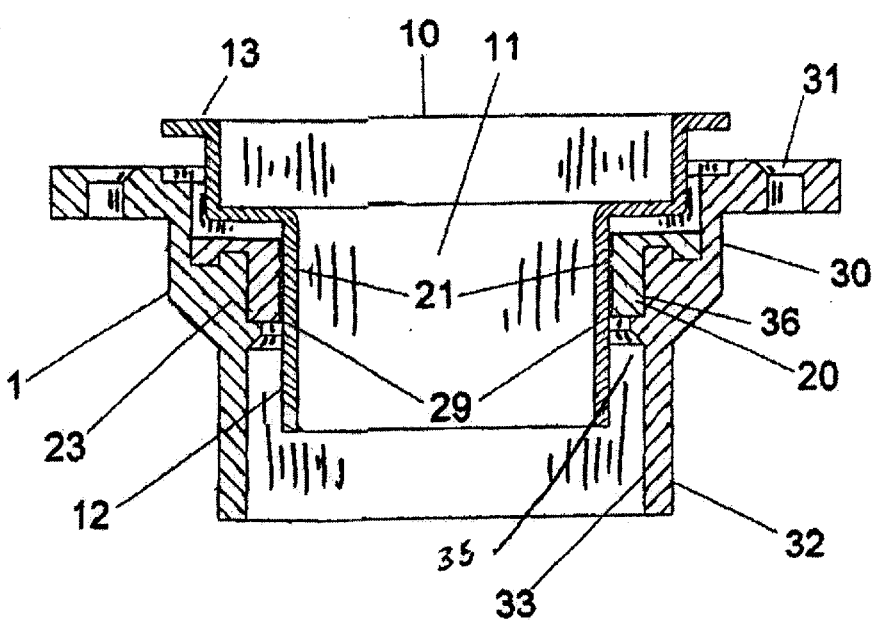
FIG. 3 illustrates a side sectional view, taken along line 3—3 shown in FIG. 2, of the assembly in FIG. 2.

As shown in FIGS. 2, 3 and 5, once installed, the extension member 14 of the sleeve 10 extends from the base outlet opening 102 of the toilet base 101, down through the sleeve clearance 22 of the v-ring seal 20, and into the floor flange 30, extending past the stop ridge 35. Thus, water flushing from the toilet 100 flows through the opening 102 of the toilet 100, through the extension member 14 of the sleeve 10, directly into the soil pipe.

In the event of back flush, where waste water flows up through the soil pipe to the floor flange 30, additional pressure from the back flush is placed on the wiper seal 29 of the v-ring seal 20, causing the wiper seal 29 to bow slightly inward toward the extension member 14, effectively causing a tighter seal between the v-ring seal 20 and the extension member 14 of the sleeve 10 during back flush.

In the event the floor flange 30 is installed below the floor surface, the v-ring seal 20 is seated within the floor flange 30 as discussed above, and the extension member 14 is advanced through the seal 20, also as previously discussed, but leaving a slight clearance between the top surface 27 of the v-ring seal 20 and the lower face 15 of the sleeve 10 to compensate for the said distance between the floor flange 30 and the floor surface. In such case, as previously discussed, a proper seal will continue to exist between the toilet 100 and the floor flange 30.

Further, the components of the kit 1 are reusable. As such, in the event the toilet 100 is replaced or temporarily removed, the components of kit 1, namely the extension sleeve 10, the v-ring seal 20, and the floor flange 30, do not need to be replaced, but may be reused and installed as described above.

Although the description above contains many specificities, these should not be construed as limiting the scope of the invention but as merely providing illustrations of a presently preferred embodiment of this invention.

Thus the scope of the invention should be determined by the appended claims in the formal application and their legal equivalents, rather than by the examples given.

I claim:

1. A sealing kit for connecting a flush toilet to a soil pipe, said sealing kit comprising:

a substantially cylindrical floor flange including an upper flange portion, a downwardly projecting extension for mating with a soil pipe, and an upper surface defining a groove;

a ring having a downwardly-projecting lip that is received by said groove, said ring seal defining a substantially cylindrical interior sealing surface, said ring further including an upwardly projecting sealing lip and a wiper seal parallel with the sealing lip on said interior sealing surface; and a toilet base extension sleeve having a substantially flat upper surface for mating with the toilet outlet and a substantially cylindrical sleeve portion projecting downwardly from said flat upper surface and defining inner and outer surfaces, wherein the outer surface of said sleeve portion is sealingly received inside said substantially cylindrical interior sealing surface of said ring seal.

2. A sealing kit for connecting a flush toilet to a soil pipe, said sealing kit comprising:

a substantially cylindrical floor flange including an upper flange portion and a downwardly projecting extension for mating with a soil pipe;

a ring seal which seats within the floor flange and defines a substantially cylindrical interior sealing surface, said ring seal including an inwardly-directed, upwardly projecting sealing lip and a inwardly-directed wiper seal parallel with the sealing lip on said interior sealing surface; and a toilet base extension sleeve having a substantially flat upper surface adhered to the toilet outlet and a substantially cylindrical sleeve portion projecting downwardly from said flat upper surface and defining inner and outer surfaces, wherein the outer surface of said sleeve portion is sealingly received inside said substantially cylindrical interior sealing surface of said ring seal and extends into the soil pipe.

3. An assembly connecting a flush toilet outlet to a soil pipe, said assembly comprising:

a substantially cylindrical floor flange including an upper flange portion, an upper surface defining a groove, and a downwardly projecting extension having at least one stop, wherein said cylindrical floor flange is mounted onto a soil pipe having a top edge, wherein the top edge of the soil pipe abuts the stop of the floor flange;

a ring seal having a downwardly-projecting lip that is received by said groove of the floor flange, and said ring seal defining a substantially cylindrical interior sealing surface, and including an inwardly-directed, upwardly projecting sealing lip and a inwardly-directed wiper seal parallel with the sealing lip on said interior sealing surface; and a toilet base extension sleeve having a substantially flat upper surface adhered to the toilet outlet and a substantially cylindrical sleeve portion projecting downwardly from said flat upper surface and defining inner and outer surfaces, wherein the outer surface of said sleeve portion is sealingly received inside said substantially cylindrical interior sealing surface of said ring seal and extends into the soil pipe.

* * * * *